US008444338B2

(12) United States Patent
Kurek et al.

(10) Patent No.: US 8,444,338 B2
(45) Date of Patent: May 21, 2013

(54) HOUSING

(75) Inventors: John S. Kurek, Goshen, NY (US); David Cerutti, Putnam Valley, NY (US)

(73) Assignee: Avon Products, Inc., New York, NY (US)

( * ) Notice: Subject to any disclaimer, the term of this patent is extended or adjusted under 35 U.S.C. 154(b) by 502 days.

(21) Appl. No.: 12/373,932

(22) PCT Filed: Sep. 6, 2007

(86) PCT No.: PCT/US2007/077699
§ 371 (c)(1), (2), (4) Date: Feb. 23, 2009

(87) PCT Pub. No.: WO2008/030917
PCT Pub. Date: Mar. 13, 2008

(65) Prior Publication Data

US 2009/0311032 A1 Dec. 17, 2009

Related U.S. Application Data

(60) Provisional application No. 60/842,899, filed on Sep. 7, 2006.

(51) Int. Cl.
*B43K 23/00* (2006.01)

(52) U.S. Cl.
USPC ..... 401/89; 401/88; 401/129; 401/195

(58) Field of Classification Search
USPC ..... 401/88, 89, 123–126, 129, 195
See application file for complete search history.

(56) References Cited

U.S. PATENT DOCUMENTS

| | | | | |
|---|---|---|---|---|
| 2,566,016 | A | 8/1951 | Cochran | |
| 3,215,264 | A | 11/1965 | Silson et al. | |
| 4,659,242 | A * | 4/1987 | Katz | 401/89 |
| 6,387,068 | B1 * | 5/2002 | Naughton | 401/125 |
| 6,505,631 | B2 * | 1/2003 | Fischer et al. | 401/129 |
| 7,845,871 | B2 * | 12/2010 | Thiebaut | 401/126 |

FOREIGN PATENT DOCUMENTS

CA 2267452 C 4/1998

* cited by examiner

*Primary Examiner* — Tuan N Nguyen
(74) *Attorney, Agent, or Firm* — David M Joyal; Charles J Zeller; Joan M McGillycuddy

(57) ABSTRACT

An applicator device includes an applicator unit for applying a first cosmetic article to a user and a housing, which includes a cavity for holding a second cosmetic article for use by the user. An activator unit may be used to bring the second cosmetic article in reach of the user.

14 Claims, 7 Drawing Sheets

HOUSING

RELATED APPLICATIONS

This application claims priority to International Application Serial No. PCT/US07/77699 filed Sep. 6, 2007 which claims priority to U.S. Ser. No. 60/842,899, filed on 7 Sep. 2006, hereby fully incorporated by reference.

BACKGROUND OF THE INVENTION

1. Field of the Invention

The present invention relates to a housing in an applicator device usable for applying a cosmetic to the body of a user, and, in particular, to a housing that provides the user access to an additional cosmetic article.

2. Description of the Related Art

Cosmetic applicator devices ("applicator devices") apply a cosmetic onto the body of the user. Applicator devices are typically configured of two structural types. In a first type, the applicator device includes an applicator unit that is joined via a rod and/or wand ("wand") to a handle. The user holds the applicator device by the handle and applies the cosmetic. One example is a mascara brush ("mascara applicator") includes a brush, i.e. applicator unit, attached via rod embedded in a handle. A further example is a lip-gloss applicator ("lip gloss applicator") wherein a wand joins a swab brush, i.e. applicator unit, to the handle.

In a second type, the applicator device includes an applicator unit that effectively is the handle. A removable cap protects the applicator unit during storage. One example of the present type of applicator device is an eyeliner or lip liner pencil.

Even experienced users of applicator devices make mistakes that require correction. When the user is at a home, the user may deal with such a mistake easily since she has many ancillary cosmetic articles ("cosmetic articles") to correct the mistake, readily available. For example, she may reach for cotton swabs that are in a medicine closet or tissues that sit readily available in a tissue box. However, when the user is not at home, she must carry such items with her to use when needed.

Although, small packages, i.e. travel packages, or purse packages, are known, the ancillary cosmetic articles are provided in bulk, i.e., the quantity typically exceeds that needed during the lifetime of the applicator device. Thus, the user is weighed down unnecessarily.

Furthermore, the cosmetic articles may not be best suited for the purpose required. Thus, a user either must carry excess quantities of many types of additional articles suited for cosmetic removal to achieve preferred results or in the absence of these removers be willing to suffer inferior results.

As corollary, it should, of course, be appreciated that where a cosmetic article may be needed to enhance the cosmetic being applied by the user with the applicator device, similar problems result. Therein, a user may be forced to carry excess quantities rather than a matched quantity, and/or use an item that actually does not provide a preferred match.

Therefore, what is desired is a means to match a cosmetic article that enhances the use of the cosmetic applied with the applicator device, either in removal or in additional application. What is also desired is that the cosmetic article preferably is provided in quantities suitable for the applicator device.

SUMMARY OF THE INVENTION

These and other needs are met by the inventive housing for an applicator device of the present invention. The inventive housing captures the significant space available in the handle or cap of an applicator device and permits cosmetic articles to be provided that enhance the user's experience with the applicator device.

An applicator device includes an applicator unit for applying a first cosmetic article to a user and a housing, which includes a cavity for holding a second cosmetic article for use by the user. An activator unit may be used to bring the second cosmetic article in reach of the user.

Furthermore, in accordance with one embodiment of the present invention the second cosmetic article are selected to work specifically with the cosmetic of the applicator device.

DETAILED DESCRIPTION OF THE DRAWINGS

Figure 1:
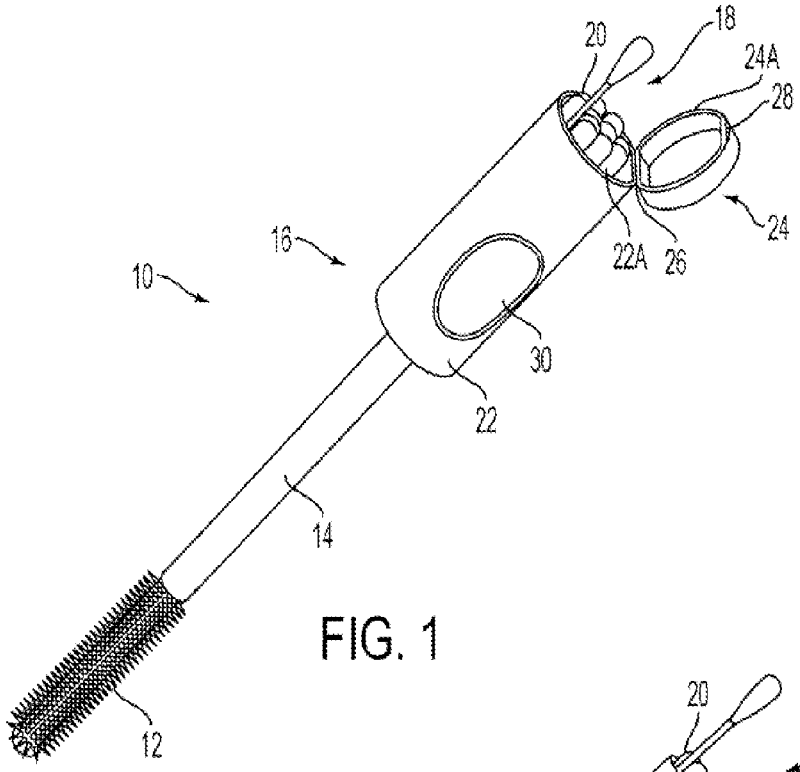
FIG. 1 is an isometric view of a portion of an applicator device of the first structural type comprising the inventive housing in accordance with one embodiment of the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, left, right, up, down, over, above, below, beneath, rear, and front may be used with respect to the drawings. These and similar directional terms should not be construed to limit the scope of the invention in any manner. The words "attach," "connect," "couple," and similar terms with their inflectional morphemes do not necessarily denote direct and immediate connections, but also include connections through mediate elements or devices.

FIGS. 1 and 2 are applicator devices having the aforementioned first and second structural types and each includes the inventive housing.

Therein, FIG. 1 is an isometric view of a portion of an applicator device of the first structural type comprising the inventive housing in accordance with one embodiment of the present invention. Applicator device 10 includes an applicator unit 12 and a rod or wand ("wand") 14, which connects the applicator unit to a housing 16 usable as a handle. Housing 16 includes a cavity 18 for storing one or more cosmetic articles 20 in the housing component.

When not in use, a vial typically retains applicator unit 12 and wand 14 to store and protect the applicator unit and/or wand. A vial holds a cosmetic article, for example, mascara, or gloss. To use the applicator device, the user dips at least a portion of the applicator unit into the vial to transfer the cosmetic article to the applicator unit, and then applies the cosmetic article to their body. Therein, the applicator unit may be configured as a brush for applying mascara, but may also be a soft applicator for applying lip-gloss or the like. Other uses are also contemplated.

Figure 2A:
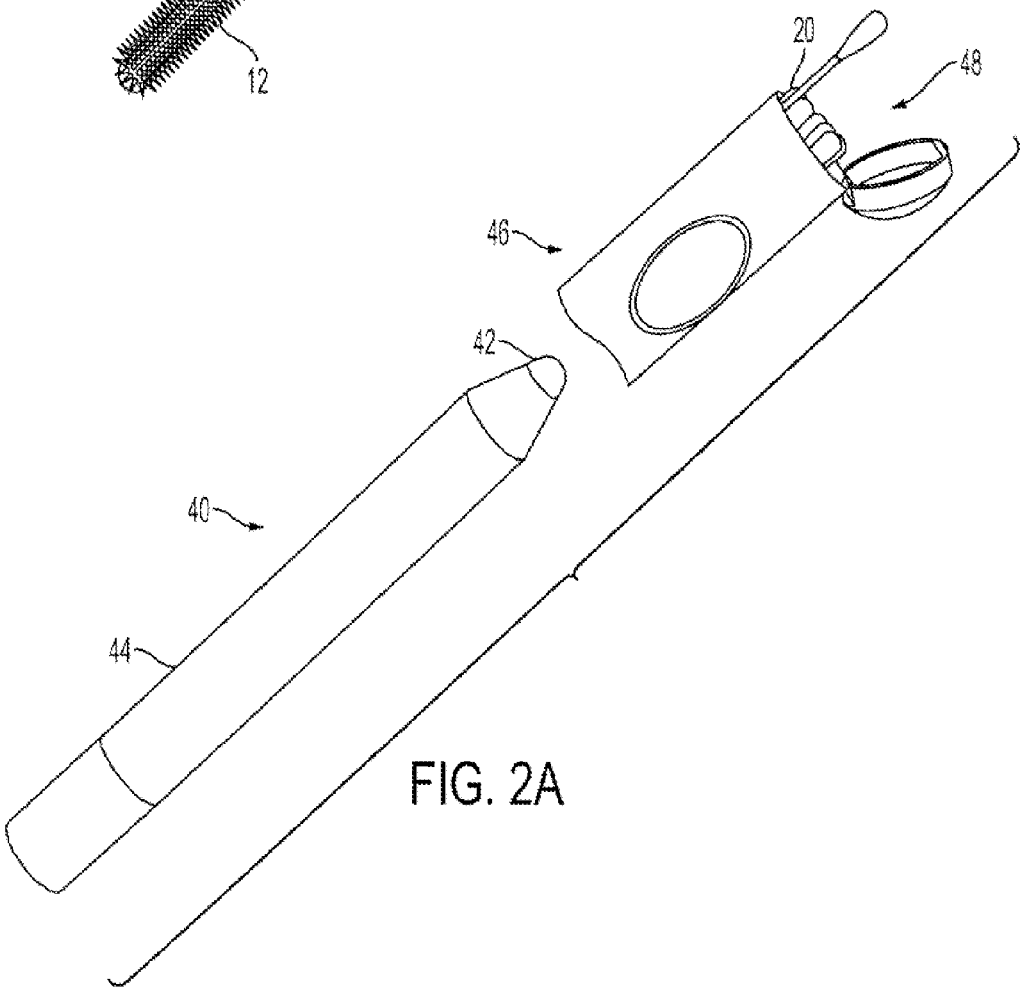
FIG. 2A is an isometric view of an applicator device of the second structural type comprising the inventive housing in accordance with one embodiment of the present invention.
Figure 2B:
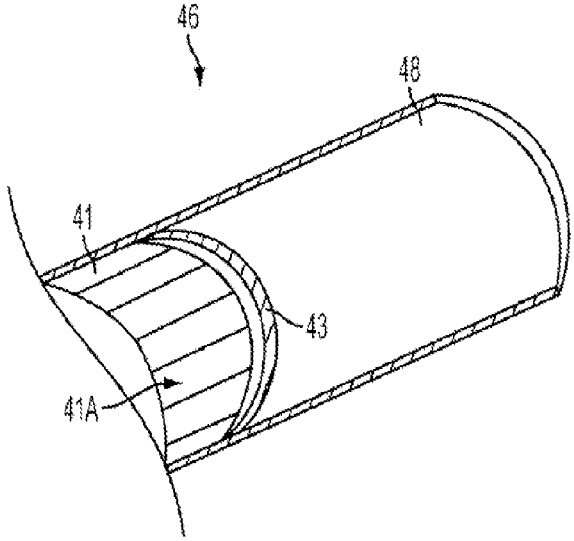
FIG. 2B is a cross-sectional view of the inventive housing of FIG. 2A.

FIG. 2A is an isometric view of an applicator device of the second structural type comprising the inventive housing in accordance with one embodiment of the present invention. FIG. 2B is simplified a cross-sectional view of the inventive housing of FIG. 2 showing the frictional fit component. Applicator device 40 is configured as a pencil and includes an applicator unit 42 that comprises a cosmetic article. The applicator device further includes a holding portion 44 usable for handling the applicator unit.

Typically, a frictional fit component, such as a reduced cross-sectional area, in a cap (not shown) retains the applicator unit and an adjacent portion of the holding portion. In the present invention, inventive housing 46 retains the applicator unit and an adjacent portion of the holding portion to protect and/or store the applicator unit. Housing 46 comprises a cavity 48 for storing one or more cosmetic articles 20 in the housing and a frictional fit component 41.

The frictional fit component 41 includes a plurality of segments 41*a* (FIG. 2B) that match the shape of the holding portion. A partition 43 may be provided in the housing to separate the cavity from the applicator unit. Advantageously, the partition may be shaped to maximize the space of the cavity, and, thus, may be non-planar in order, for example, to provide ample room for the applicator unit.

In use, the user removes housing 46 to expose the applicator unit and applies the cosmetic article. Therein, the applicator unit may be a coloring tip and the applicator device may be an eyeliner or a lip liner.

In either case, when the user wishes to correct an errant or mistaken application of the cosmetic article, the user may select one or more cosmetic articles 20 from inventive housing 16, 46. Thus, it should be appreciated that the structure of the inventive housing is substantially similar regardless of the applicator type, and that the following description of the inventive housing for an applicator device of a first structural type also describe the inventive housing for an applicator device of a second structural type as modified with respect to the above details.

Returning to FIG. 1, the details of applicator device 10 are now explained. Housing 16 includes a body portion 22 and may include a lid 24 joined by a hinge 26, which may be a living hinge, to body portion 22. The lid preferably includes a finger pry 28 that permits easy opening of the lid.

Housing 16 may be configured to have any cross-sectional shape or more particularly as cross-sectional shape that suits the product being applied to the applicator unit. Thus, mascara applicators may require a circular cross-sectional shape such that body portion 22 has an exterior cylindrical surface. Lip gloss applicators may have a rectangular cross-sectional shape and, thus, body portion 22 may be have an exterior box surface.

The cross-sectional periphery of the lid may be configured to match cross-sectional periphery of body portion 22 so that edge 24*a* of the lid substantially meets edge 22*a* of the body portion.

Housing 16 may also include finger grip portions 30 that permit the user to more easily handle applicator device 10.

Preferably, housing 16 has any suitable dimensions. For example, the housing may have a diameter of 0.630 inches, which may be standard in the art. The cosmetic article may also have any suitable dimension. For example, the cosmetic article configured as a swab may have a shaft of 0.060 inches in diameter, a swab 0.115 inches in diameter, and an overall of 1.5 inches in length. However, the cosmetic article may have a range for a shaft of 0.050-0.075 inches in diameter, a swab range of 0.100-0.140 inches in diameter, and an overall range of 1.0-1.5 inches in length.

FIG. 3 is a simplified cross-section of the inventive housing of FIG. 1. Housing 16 may include threads 32 so that applicator device 10 may be secured on the vial (not shown).

Wand 14 may be integral with a partition 34 and is joined to housing 16 secured in the interior of body portion 22. Therein, the wand maybe glued, heat, or sonic welded to the partition or by some other means secured to be rigidly disposed in the housing and yet permit a user to apply the cosmetic article.

Cavity 18 is defined at least by the volume created in body portion 22 between partition 34 and edge 22*a*. Therein, partition 34 may be planar or may have a shape and/or location that suitably maximize the volume of cavity 18. For example, if threads 32 are not required, partition 34 may be disposed more distal from edge 22*a* than when such threads are required. In another example, partition 34 may have a non-planar surface as will be taught with respect to FIG. 4.

Lid 24 may be shaped to include rim walls 24*b*, which advantageously expose distal portions of cosmetic articles 20 so that a particular article may be easily selected.

Lid 24 further may include a domed or other non-planar roof 24*c* so that a cavity 18*a* is formed in by the volume defined along the rim walls and between the roof and edge 24*a*. Cavity 18*a* may serve to increase the volume of cavity 18.

Figure 4:
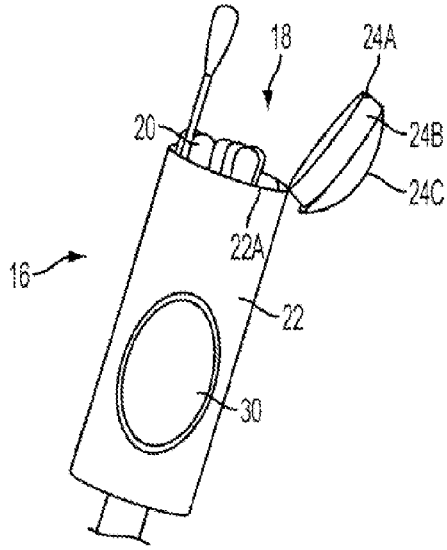
FIG. 4 is a side view of the inventive housing of FIG. 1.

FIG. 4 is a side view of the inventive housing of FIG. 1. Cosmetic article 20 may be any article that is useful for the user's grooming, for example cotton swabs, i.e., cotton buds. As will be taught with respect to other embodiments, the cosmetic article may also be wet or dry wipes, or any other suitable natural or manmade article, such as cotton halls, tissues, etc.

In one embodiment, cosmetic article 20 is a cotton swab, i.e. cotton buds such as Q-TIP™ brand products. The cottons swab may be configured to have one or two buds and preferably have a carrier length suitable for storage in cavity 18.

Figure 5:
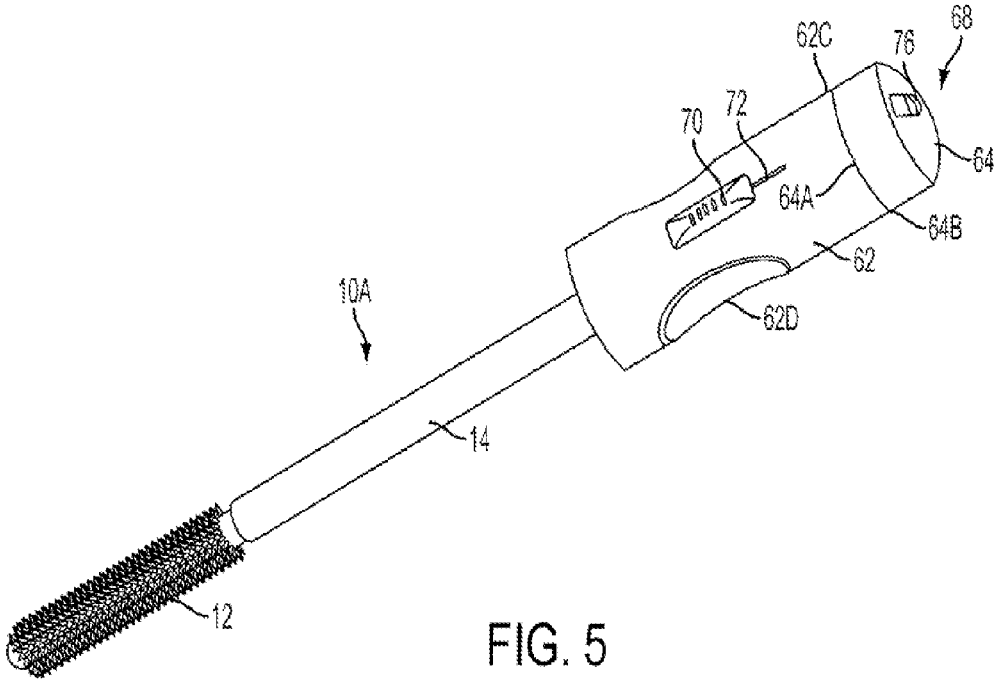
FIG. 5 is an isometric view of a portion of an applicator device having an inventive housing in a first operational state in accordance with a further embodiment of the present invention.
Figure 6:
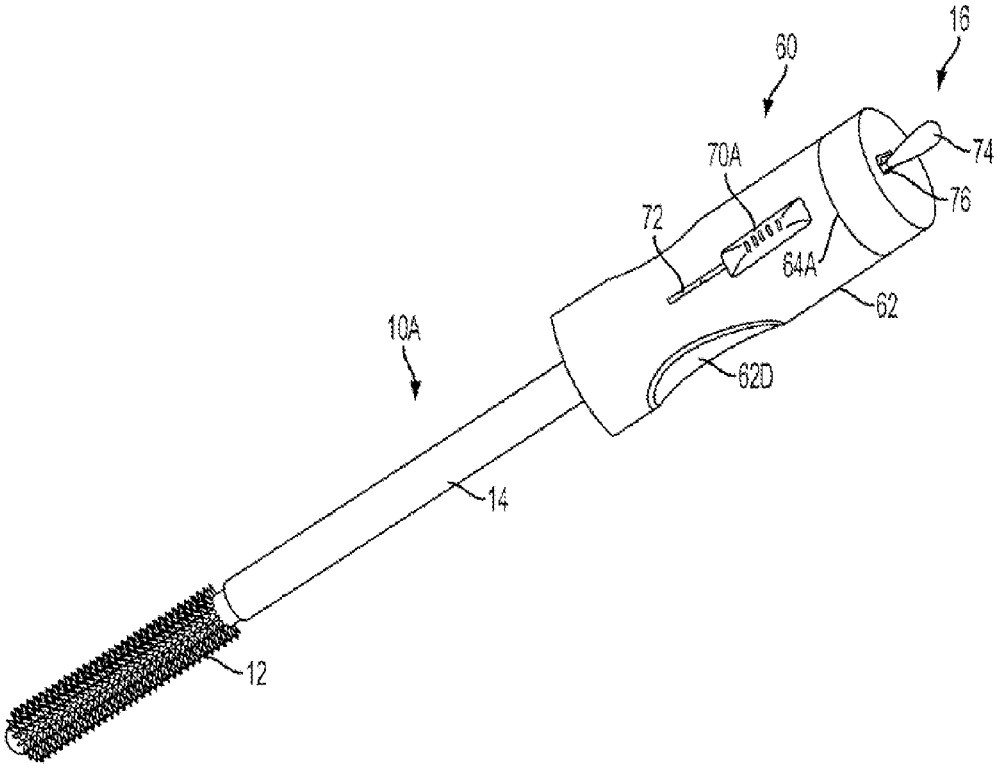
FIG. 6 is an isometric view of a portion of an applicator device having an inventive housing in a second operational state in accordance with a further embodiment of the present invention.
Figure 7:
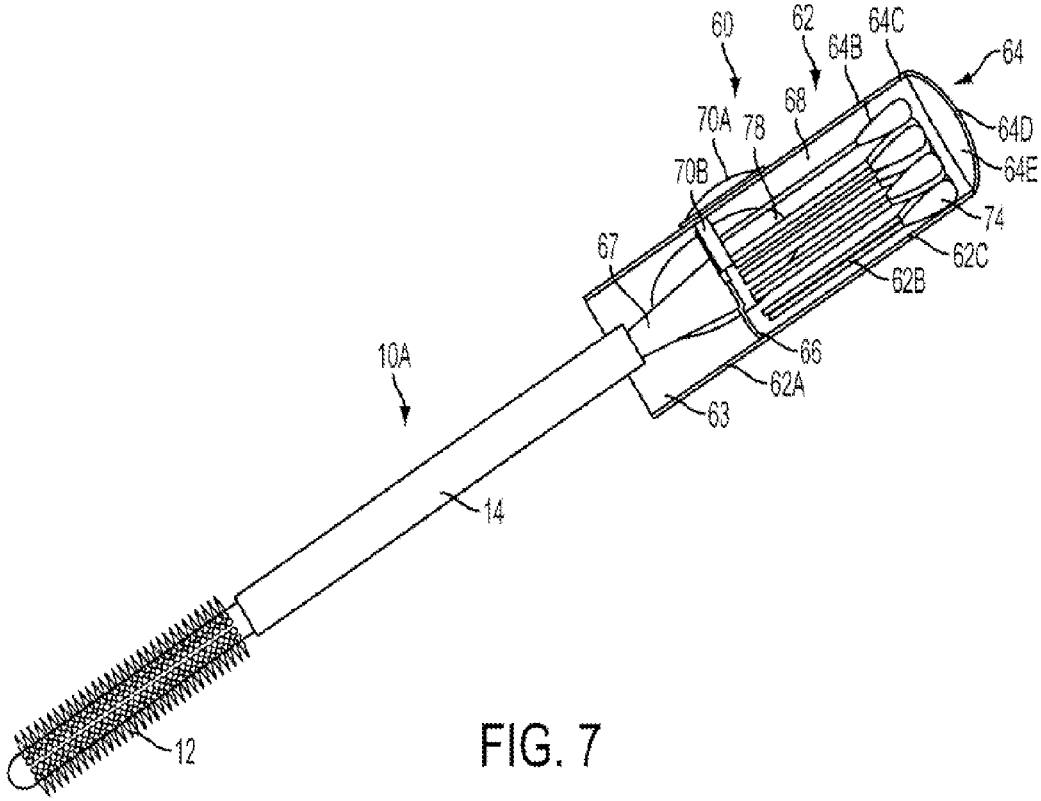
FIG. 7 is a simplified cross-sectional view through FIG. 5.

FIGS. 5-8 illustrate a further embodiment of the present invention. Therein, FIG. 5 is an isometric view of a portion of an applicator device having an inventive housing in a first operational state in accordance with a further embodiment of the present invention. FIG. 6 is an isometric view of a portion of an applicator device having an inventive housing in a second operational state in accordance with a further embodiment of the present invention. FIG. 7 is a simplified cross-sectional view through FIG. 5. FIG. 8A is a modified isometric view of cosmetic articles in the applicator device of FIG. 5. FIG. 8B is a diagrammatic view without cosmetic articles of FIG. 8A illustrating a plurality of bumpers.

The inventive housing, housing 60, has a size and shape suitable for use as a handle in an applicator device 10*a* of the first structural type or as a cap in an applicator device of the second structural type. Thus, housing 60 may be cylindrical, decahedral, or any other shape; wherein a cylindrical is preferably used.

The housing includes a body 62 and a lid 64. Lid 64 may be removable from the body portion 62 or may be hinged to the body 62 via, for example, a living hinge. Lid 64 preferably includes a finger ply 64*a* disposed on an edge 64*b* created by one or more walls 64*c*, which may be formed upright. Walls 64*c* and roof 64*d*, preferably formed domed, create a cavity 64*e* in the lid.

A transverse partition 66 divides the body into a lower body portion 62*a* and an upper body portion 62*b*.

Figure 3B:
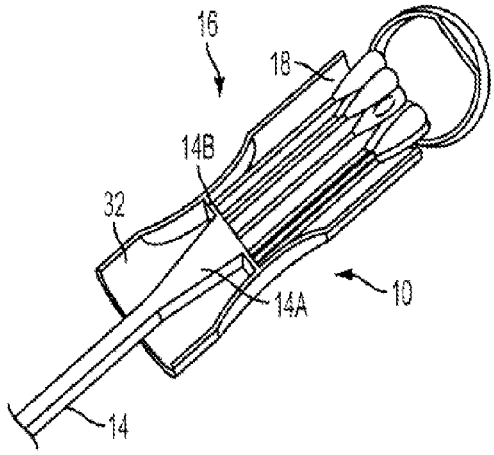
FIG. 3B is an alternative embodiment of the wand being joined to the inventive housing of FIG. 1.

It should be appreciated that the wand may be joined to the body in numerous ways. FIG. 3B is an alternative embodiment of the wand being joined to the inventive housing of FIG. 1. Therein, wand 14 may be formed integrally with a rod head 14*a*. The rod head and wand are then press-fit and/or glued into the body that includes pre-formed threads 32, if so required, for coupling with a vial. Therein, the partition, may be the top of the rod head, for example, partition 14*b*.

In accordance with a further embodiment of the present invention, the wand may be formed integrally with a rod head that includes threads, if so required, for coupling with a vial. The rod head and wand are then press-fit and/or glued into the body. Therein, the partition may be the top of the rod head.

In an applicator of the first structural type, a mount 67 is preferably integrally formed in the partition and projects in the lower body portion. A wand 14 having an applicator unit 12 is press fit onto the mount to provide a durable connection.

To couple the vial of an applicator device of the first structural type and the inventive housing 60, threads 63 are provided on an interior of housing 60. In the alternative, other means for coupling the vial and the housing such as snap fits may be provided in housing 60.

In an applicator device of the second structural type, the lower body portion 62*a* includes a frictional fit component, such as component 41 (FIG. 2B), for the user to seat a portion of the applicator device in housing 60.

Regardless of the applicator device type, inventive housing 60 includes a cavity 68. Cavity 68 is defined at least by the volume created in the upper body portion between partition 66 and an upper edge 62*c* of body 62. Body 62 may also include finger grips 62*d*, which may be configured as indentations in body 62 that may reduce the volume of cavity 68.

Housing 60 further includes an actuator 70. Actuator 70 comprises a tactile unit 70*a*, configured as a slide button or the like, on the exterior body 62 and a grasp 70*b* disposed in the interior of body 62. The tactile unit and the grasp are rigidly joined together.

As is known in the art, tactile unit 70 may have a leaf spring, either a single or split leaf design, coupled to the underside of tactile unit 70*a*. Thus, the spring would tension against the outside of the body 62 and force a portion of the grasp against the inside of body to frictionally resist unwanted movement of the actuator. When desired, actuator 70 travels in a guide 72 to lift a cosmetic article 74 through an opening 76 provided in the lid.

In use, one or more cosmetic articles 74, preferably a pack of cosmetic articles are inserted into cavity 68 by opening lid 64. Cosmetic article 74 may be a cotton swab, i.e. a cotton bud, having one end of the stalk be a cotton bud or both. The cosmetic article may also be a coated with a further cosmetic article or the like. The cosmetic article may also be a manmade article of any shape, but preferably having a longitudinal element to which absorbent material is joined.

The size of the cosmetic article may be chosen to fit within cavity 68 and may also take advantage of cavity 64*e* in the lid.

In use, a user may use applicator device 10*a* to apply a cosmetic article to their body. When an errant or mistaken application is made, the user may use actuator 70, by depressing tactile unit 70*a* to reduce the tension in the spring, and the actuator in the guide until one of the cosmetic articles is lifted into reach (as shown in FIG. 6).

Figure 8B:
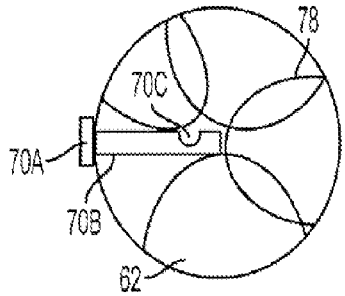
FIG. 8B is a diagrammatic view without cosmetic articles of FIG. 8A illustrating a plurality of bumpers.
Figure 8A:
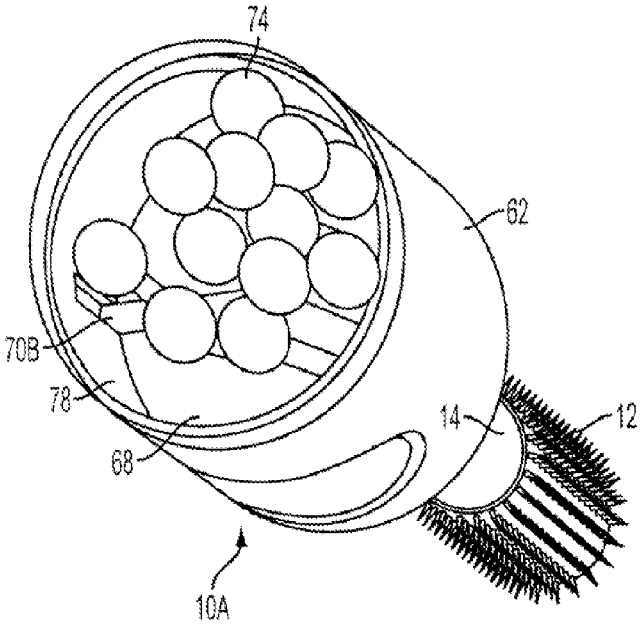
FIG. 8A is a modified isometric view of cosmetic articles in the applicator device of FIG. 5.

FIG. 8A is a modified isometric view of cosmetic articles in the applicator device of FIG. 5. FIG. 8B is a diagrammatic view without cosmetic articles of FIG. 8A illustrating a plurality of bumpers. Grasp 70*b* is able to hold and raise a cosmetic article. Thereto, for example, grasp 70*b* includes a notch 70*c* that is able to engage a cosmetic article by its stalk. Thus, preferably an end portion of the guide is located so that the grasp 70*b* and/or notch 70*c* engages the stalk at a portion distal from the portion lifted through opening 76. However, the location of the end portion permits convenient engagement and prevent the cosmetic article from tipping over when it is initially engaged.

In order to guide cosmetic articles to the grasp 70*b* and/or notch 70*c*, one or more bumpers 78 are disposed in the interior of upper body portion 62*b* The bumpers are preferably flexible and may be metal or plastic springs. The bumpers may be permanently joined to the interior side of the upper body portion. The bumpers are preferably located so that they press on the cosmetic articles without damage and guide the cosmetic articles to grasp 70*b* and/or notch 70*c*. Bumpers 78 overlap each other except in the area of grasp 70*b* and/or notch 70*c* when cavity 68 is devoid of cosmetic articles (as shown in FIG. 8B). Therein, the bumpers are arranged at different elevations to be able to guide the cosmetic articles.

In a further embodiment, one or more cosmetic articles 74 are provided in a bandolier that may be disposed in a coil for easy insertion and/or refill in cavity 68. Grasp 70*b* and/or notch 70*c* engage one of the bandoliered cosmetic articles and when lifting the cosmetic article disconnects the cosmetic article from the bandolier. Therein, cosmetic articles 74 may be joined in a bandolier using breakable tape and may be spaced apart from each other for easier engagement of actuator 70.

Figure 9:
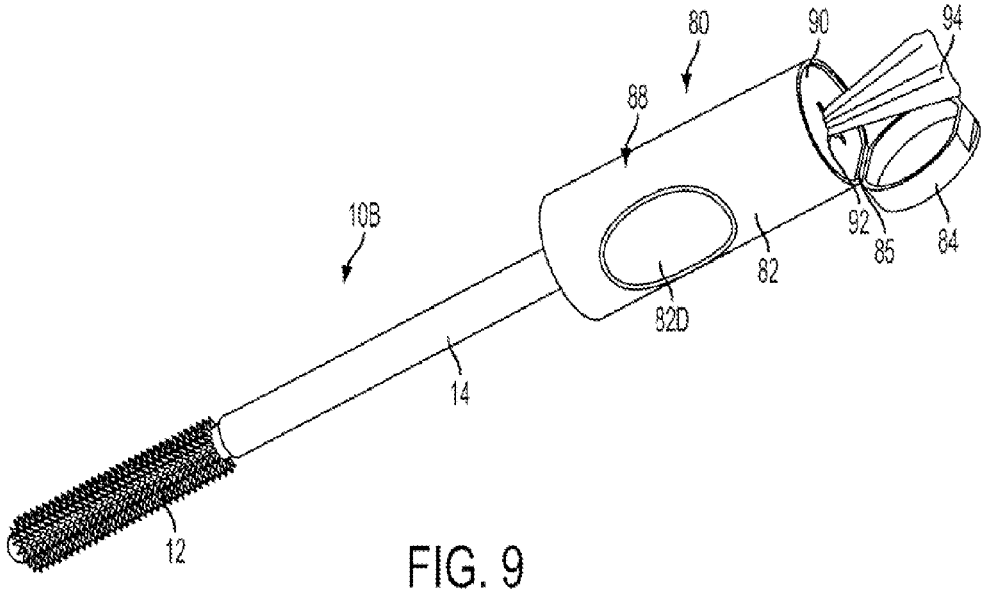
FIG. 9 is an isometric view of a portion of an applicator device comprising an inventive housing in accordance with a further embodiment of the present invention.
Figure 10:
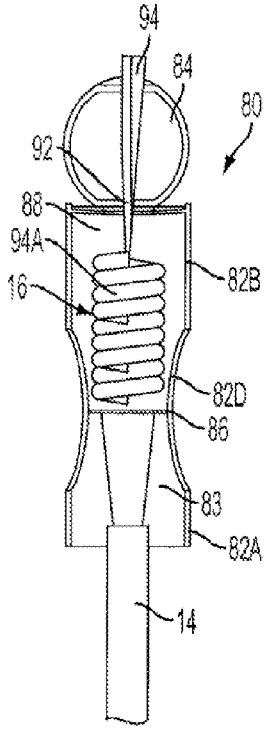
FIG. 10 is a simplified cross-sectional view of a portion the applicator device of FIG. 9.
Figure 11:
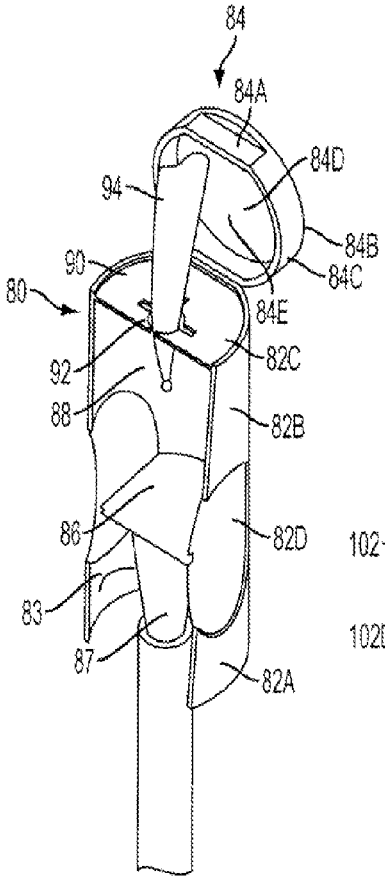
FIG. 11 is an isometric cross-sectional view of a portion of the applicator device of FIG. 9.

FIGS. 9-11 illustrate a further embodiment of the present invention. Therein, FIG. 9 is an isometric view of a portion of an applicator device comprising an inventive housing in accordance with a further embodiment of the present invention. FIG. 10 is a simplified cross-sectional view of a portion the applicator device of FIG. 9. FIG. 11 is an isometric cross-sectional view of a portion of the applicator device of FIG. 9.

The inventive housing, housing 80, has a size and shape suitable for use as a handle in an applicator device 10*b* of the first structural type or as a cap in an applicator device of the second structural type. Thus, housing 80 may be cylindrical, decahedral, or any other shape.

The housing includes a body 82 and a lid 84. Lid 84 may be removable from the body portion 82 or may be hinged to the body 82 via; for example, a living hinge 85. Lid 84 preferably includes a finger pry 84*a* disposed on an edge 84*b* created by one or more walls 84*c*, which may be formed upright. Walls 84*c* and roof 84*d*, preferably formed domed, create a cavity 84*e* in the lid.

A transverse partition 86 divides the body into a lower body portion 82*a* and an upper body portion 82*b*.

It should be appreciated that the wand may be joined to the body in numerous ways. In accordance with one embodiment of the present invention, the wand may be formed integrally with a rod head as taught with respect to FIG. 3B. The rod head and wand are then press-fit and/or glued into the body that includes pre-formed threads, if so required, for coupling with a vial. Therein, the partition may be the top of the rod head.

In accordance with a further embodiment of the present invention, the wand may be formed integrally with a rod head that includes threads, if so required, for coupling with a vial. The rod head and wand are then press-fit and/or glued into the body. Therein, the partition may be the top of the rod head.

In an applicator of the first structural type, a mount 87 is preferably integrally formed in the partition and projects in the lower body portion. A wand 14 having an applicator unit 12 is press fit onto the mount to provide a durable connection.

To couple the vial of an applicator device of the first structural type and the inventive housing 80, threads 83 are provided on an interior of housing 80. In the alternative, other means for coupling the vial and the housing such as snap fits may be provided in housing 80.

In an applicator device of the second structural type, the lower body portion 82*a* includes a frictional fit component, such as component 41 (FIG. 2B), for the user to seat a portion of the applicator device in housing 80.

Regardless of the applicator device type, inventive housing 80 includes a cavity 88. Body 82 may also include finger grips 82*d*, which may be configured as indentations in body 82 that may reduce the volume of cavity 88.

Housing 80 further includes a panel 90. Panel 90 is disposed transverse to body 82 at or proximal to edge 82*c* and closes an interior space of the upper body portion from the exterior. Thus, cavity 88 is defined at least by the volume created in the upper body portion between partition 86 and panel 90.

Panel 90 preferably is removable from body 82 to permit the insertion of one ore more cosmetic articles 94 configured preferably as disposable wipes. Therein, cosmetic articles 94 may be arranged as known in the art as pop-up dispensing pack (pack 94*a*), or sheet-feeding articles via folding the prior member with respect to the succeeding article, wherein a first cosmetic article pulls a further cosmetic article from below.

The cosmetic articles 94 may also be arranged in a coil and separable by series of spaced perforations.

The cosmetic articles are also preferably impregnated with, for example, an antiseptic agent, an ionic or anionic surfactant; or the like to increase its potential utility.

To reduce any possible evaporation of impregnating agent, panel 90 provides a minimal opening 92 which may be a cross pattern so that the portions of panel 90 disposed in the quarter segments of the cross pattern bend to permit a cosmetic article from being removed.

In use, one or more cosmetic articles 94, preferably, a pack of cosmetic articles are inserted into cavity 88 by opening lid 84 and removing panel 90. After the lid is closed, a user may use applicator device 10*b* to apply the cosmetic article to their body. When an errant or mistaken application is made, the user may use a cosmetic article 94 to make a correction.

Figure 12:
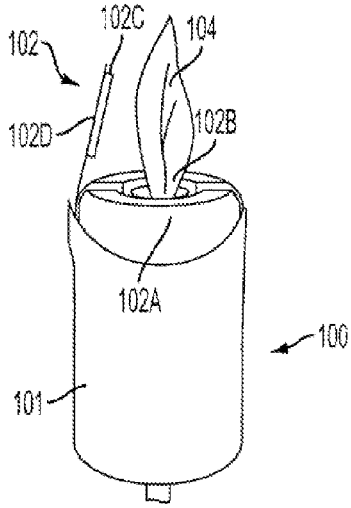
FIG. 12 is an isometric view of a portion of an applicator device comprising an inventive housing for use of pop-up wipes or sheet-feeding articles via folding the prior member with respect to the succeeding article in accordance with a further embodiment of the present invention.

FIG. 12 is an isometric view of a portion of an applicator device comprising an inventive housing for use of pop-up wipes or sheet-feeding articles via folding the prior member with respect to the succeeding article in accordance with a further embodiment of the present invention. Therein, a housing 100 includes a hollow body 101 that in cooperation with a lid 102 forms a cavity substantially in the entire inner space of the body except in a region necessary for coupling a wand or a pencil applicator.

A plurality of cosmetic articles 104 configured as pop-up wipes or sheet-feeding articles via folding the prior member with respect to the succeeding article are disposed in the housing. Such wipes are preferably arranged as is known in the art so that as a first wipe is removed a second wipe is advanced to in a position to be removed.

Preferably, the cosmetic articles are suitably sized and made of a material that aids the user. For example, the wipes may be made of material that is efficient in capturing mascara and/or make-up. The wipes may also be impregnated with an agent that aids the user, for example, a cleaning agent such as isopropanol or ethanol, i.e. SD alcohol, may be utilized. Excess impregnation material may be provided with the wipes and introduced into the housing so that the wipes retain the agent to the extent possible.

Lid 102 includes rim 102*a* that engages a peripheral edge of the body proximal to the rim to form a closure that preferably is leakage resistant to retain impregnation material, if so needed, and/or to protect and securely store the cosmetic articles.

Lid 102 further includes an opening 102*b* through which the cosmetic articles are removable. To reduces the possibility of evaporation due to the impregnating material, a minimal opening which may be formed as a cross pattern void between quarter segments of the lid comprise the opening. The quarter segments preferably bend to permit the cosmetic articles to be removed.

Lid 102 further comprises a seal 102*c* that seals opening 102*b* and may be leakage resistant. For example, the seal may comprise a planar area with walls meeting the planar area perpendicularly. The walls may be set inward (toward a center of the seal) relative to a peripheral edge so that the walls fit inside opening 102*b* while the overhang seal over the periphery of opening 102*b*. Seal 102*c* is preferably connected to the rim by a leash 102*d*.

In use, the user removes the seal and finds a cosmetic article ready for use. The user removes it and a further article is pulled up into position for subsequent removal. Preferably, the user then seals the housing 100 with the seal.

Figure 13:
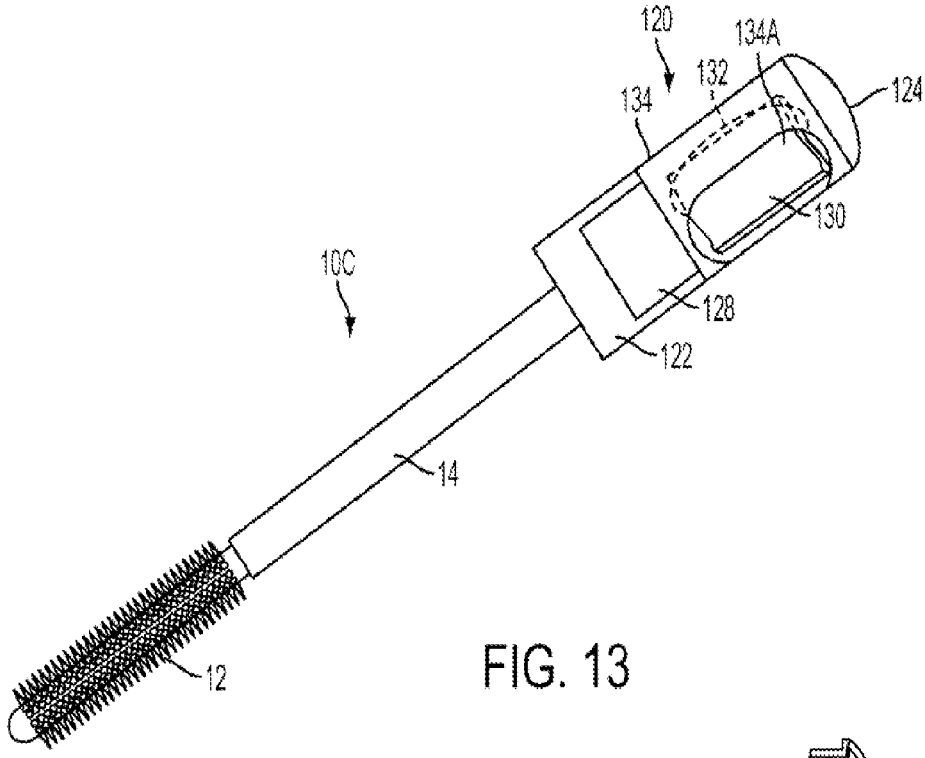
FIG. 13 is a simplified isometric view of a portion of an applicator device comprising an inventive housing for use of pop-up wipes or sheet-feeding articles via folding the prior member with respect to the succeeding article in accordance with a further embodiment of the present invention.
Figure 15:
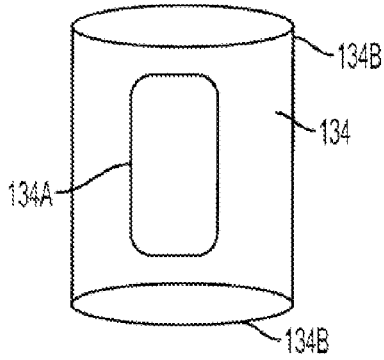
FIG. 15 is a detail of a component of the inventive housing of FIG. 13.
Figure 14:
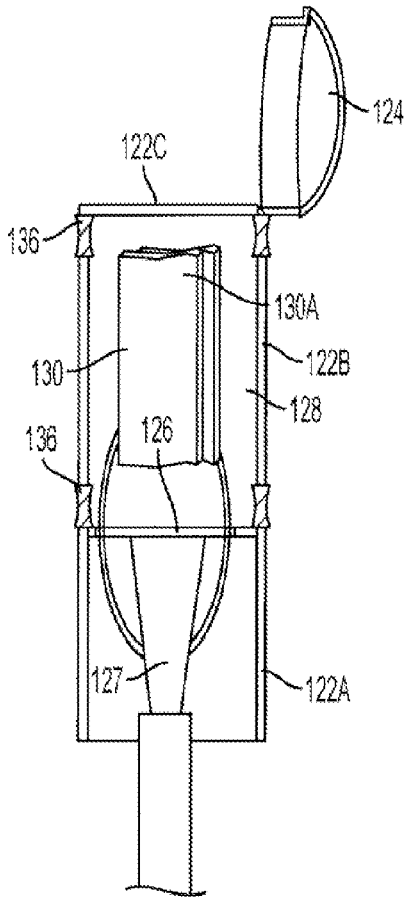
FIG. 14 is a simplified cross-sectional view of the housing of FIG. 13.

FIG. 13 is a simplified isometric view of a portion of an applicator device comprising an inventive housing for use of pop-up wipes or sheet-feeding articles via folding the prior member with respect to the succeeding article in accordance with a further embodiment of the present invention. FIG. 14 is a simplified cross-sectional view of the housing of FIG. 13. FIG. 15 is a detail of a component of the inventive housing of FIG. 13.

An inventive housing 120 has a size and shape suitable for use as a handle in an applicator device 10*c* of the first structural type or as a cap in an applicator device of the second type.

The housing includes a body 122 and a lid 124. The lid as previously taught may be removable from the body (not shown) or may be hinged to the body using, for example, a living hinge. Lid 124 may be substantially similar to lid 64.

A transverse partition includes a partition 126 divides the body into a lower body portion 122*a* and an upper body portion 122*b*.

It should be appreciated that the wand may be joined to the body in numerous ways. In accordance with one embodiment of the present invention, the wand may be formed integrally with a rod head. The rod head and wand are then press-fit and/or glued into the body that includes pre-formed threads, if so required, for coupling with a vial. Therein, the partition may be the top of the rod head.

In accordance with a further embodiment of the present invention, the wand may be formed integrally with a rod head that includes threads, if so required, for coupling with a vial. The rod head and wand are then press-fit and/or glued into the body. Therein, the partition may be the top of the rod head.

In an applicator of the first structural type, a mount 127 is preferably integrally formed in the partition and projects in the lower body portion. A wand 14 having an applicator unit is press fit onto the mount to provide a durable connection.

In an applicator device of the second structural type, the lower body portion 122*a* includes a frictional fit component, such as component 41 (FIG. 2B), for the user to seat a portion of the applicator device in housing 120.

Regardless of the applicator device type, inventive housing 120 includes a cavity 128. Cavity 128 is defined at least by the volume created in the upper body portion between partition 126 and an upper edge 122*c* of body 122. Body 122 may also include finger grips (not shown), which may be configured as indentations in a body that may reduce the volume of the cavity.

Upper body portion 122*b* comprises an aperture 132 suitably sized, shaped, and located so that one or more cosmetic articles 130 may be removed by the user. One suitable shape is an oval having a major axis parallel to a longitudinal axis of the applicator device. Therein, a suitable location of the aperture may be equidistant between edge 122*c* and the partition.

Cosmetic article 130 is preferably configured as a wipe that is sheet-fed via folding the prior member with respect to the succeeding article. The cosmetic articles may in fact be larger than the aperture and preferably are flexible so that they may be removed thereto.

Housing 120 further comprises a sleeve 134 having an opening 134*a*. The sleeve comprises one or more bearings 134*b* that are received respective grooves 136 of housing 122 to permit the sleeve to be retained in the grooves and be rotatable with respect to the body. Thus, preferably the sleeve and body have a circular transverse cross-section. Therein, the sleeve preferably has a slightly larger diameter than the body so that a space between the sleeve and the body is minimized for a tight fit.

Opening 134*a* preferably is sized to match the size of aperture 132. The opening may be located anywhere convenient on the sleeve. However, particularly suitable is a location that matches the location of aperture 132 and also is similarly sized.

Prior to use, cosmetic articles are inserted in cavity 128 by opening the lid and thereafter closing the lid. Preferably, the articles may be arranged in a pack 130*a*. The pack may comprise a folded arrangement as is known in the art wherein when an uppermost article is removed through aperture 132, the next article is positioned to be removed. Therein, it is preferred that after a first wipe is positioned in the aperture, each succeeding wipe is also positioned in the aperture.

In use, when the user wishes to use a cosmetic article 130 the user simply turns the sleeve so that it matches or nearly matches the opening in the body and pulls a cosmetic article from the housing. Preferably, as described above, a succeeding article will advance into aperture. To protect and/or store the new article, the user may then turn the sleeve so that it covers the aperture and the now exposed article. To facilitate this, all edges of opening 134 may be beveled to reduce the chance of inadvertently catching the cosmetic article.

Figure 16:
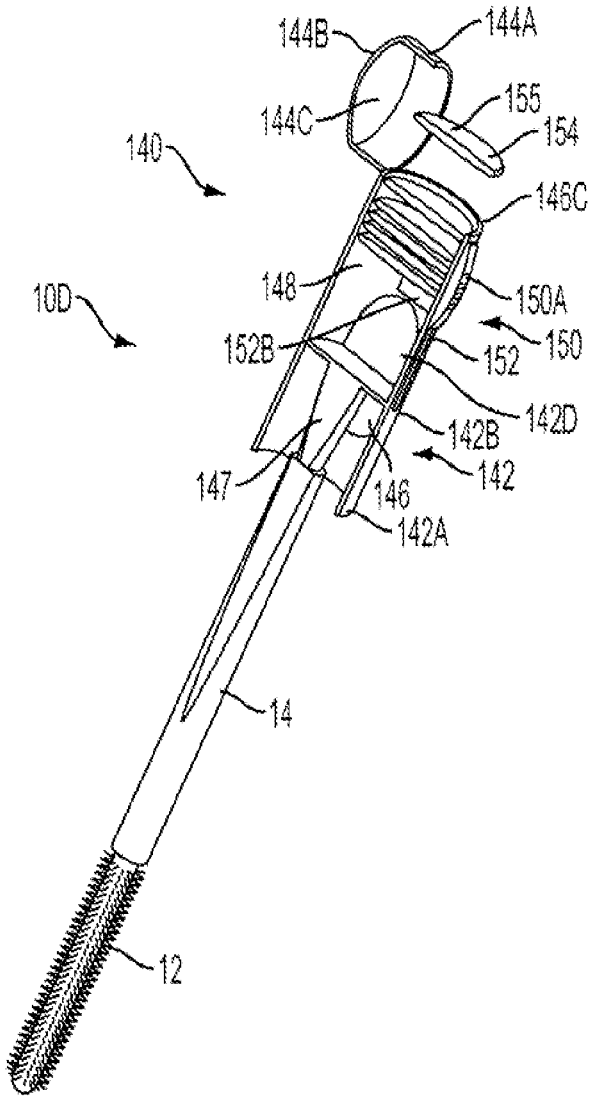
FIG. 16 is an isometric view of a portion of an applicator device having an inventive housing in accordance with a further embodiment of the present invention.

FIG. 16 is an isometric view of a portion of an applicator device having an inventive housing for use of pads in accordance with a further embodiment of the present invention. The inventive housing, housing 140, has a size and shape suitable for use as a handle in an applicator device 10*d* of the first structural type or as a cap in an applicator device of the second structural type. Thus, housing 140 may be cylindrical, decahedral, or any other shape; wherein a cylindrical is preferably used.

The housing includes a body 142 and a lid 144. Lid 144 may be removable from the body portion 142 or may be hinged to the body 142 via, for example, a living hinge. Lid 144 preferably includes a finger pry (as seen, for example, in FIG. 7) disposed on a peripheral edge created by one or more walls 144*a* of the lid, which may be formed upright. Walls 144*a* and roof 144*b*, preferably formed domed, create a cavity 144*c* in the lid.

A transverse partition 146 divides the body into a lower body portion 142*a* and an upper body portion 142*b*.

It should be appreciated that the wand may be joined to the body in numerous ways. Therein, wand 14 may be formed integrally with a rod head. In accordance with a further embodiment of the present invention, the wand may be formed integrally with a rod head that includes threads, if so required, for coupling with a vial. The rod head and wand are then press-fit and/or glued into the body. Therein, partition 146 may be the top of the rod head.

In an applicator of the first structural type, a mount 147 is preferably integrally formed in the partition and projects in the lower body portion. A wand 14 having an applicator unit 12 is press fit onto the mount to provide a durable connection.

Figure 3A:
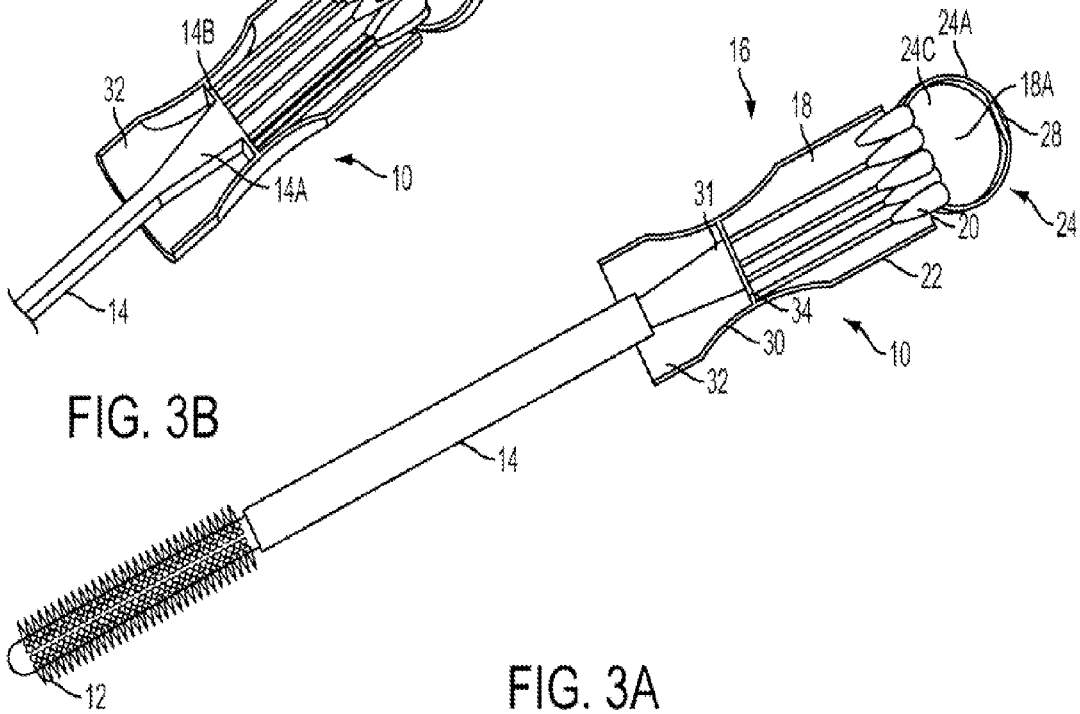
FIG. 3A is a simplified cross-sectional view of the inventive housing of FIG. 1.

To couple the vial of an applicator device of the first structural type and the inventive housing 140, threads such as threads 63, for example, illustrated in FIGS. 3A and 3B are provided on an interior of housing 140. In the alternative, other means for coupling the vial and the housing such as snap fits may be provided in housing 140.

In an applicator device of the second structural type, the lower body portion 142*a* includes a frictional fit component, such as component 41 (FIG. 2B), for the user to seat a portion of the applicator device in housing 140.

Regardless of the applicator device type, inventive housing 140 includes a cavity 148. Cavity 148 is defined at least by the volume created in the upper body portion between partition 146 and an upper edge 142*c* of body 142. Body 142 may also include finger grips 142*d*, which may be configured as indentations in body 142 that may reduce the volume of cavity 148.

Housing 140 further includes an actuator 150. Actuator 150 comprises a tactile unit 150*a*, configured as a slide button or the like, on the exterior body 142 and a lift 150*b*, configured as a transverse plate or partial plate, disposed in the interior of body 142. The tactile unit and the lift are rigidly joined together.

As is known in the art, tactile unit 150 may have a leaf spring, either a single or split leaf design, coupled to the underside of tactile unit 150*a*. Thus, the spring would tension against the outside of the body 142 and force a portion of the grasp against the inside of body to frictionally resist unwanted movement of the actuator. When desired, actuator 150 travels in a guide 152 to lift a cosmetic article 154 through the end opening of the housing.

In use, one or more cosmetic articles 154, preferably a pack of pads are inserted into cavity 148 by opening lid 144. Cosmetic article 154 may be a compressed cotton swab, woven or non-woven pad, or any other pad suitable for cosmetic purposes such as eye makeup removal. The cosmetic article may also be a coated with a further cosmetic article or the like. The cosmetic article is preferably configured to have a shape that matches the cross-sectional area of cavity 148 of upper body portion 142*b*.

The size of the cosmetic article may be chosen so that numerous articles are provided in the cavity and may also take advantage of cavity 144*c* in the lid.

Preferably, lift 152*b* is disposed below pads 154 and lifts the uppermost pad in reach of the user. To aid the user in handling the pad, each pad may be coated on a side 154*a* to the user with an adhesive 155 that adheres more strongly to the skin of the user, for example, the index finger, than to the pad overlaying it.

In use, a user may use applicator device 10*d* to apply a cosmetic article to their body. When an errant or mistaken application is made, the user may use actuator 150, by depressing tactile unit 150*a* to reduce the tension in the spring, and the actuator in the guide until one of the cosmetic articles is lifted into reach (as shown in FIG. 6).

While the invention has been described in conjunction with specific embodiments, it is to be understood that many alternatives, modifications, and variations will be apparent to those skilled in the art in light of the foregoing description.

What is claimed is:

1. An applicator device comprising:

an applicator unit for applying a cosmetic to a user;

a wand having a first and second end, the first end connected to the applicator unit;

a housing connected to the second end of the wand, the housing comprising:

an outer body portion defining an interior cavity having a lower portion and an open upper portion separated by a partition, the lower portion having the second end of the wand inserted therein, and the upper portion having a plurality of removable single-use cosmetic articles for use by the user disposed therein selected from the group consisting of swabs, cotton swabs, cotton buds, wet wipes, dry wipes, cotton balls, tissues, coated swabs, impregnated wipes, compressed cotton swabs, woven pads, non-woven pads, and coated pads; and a lid attached to the outer body portion of the housing, the lid, when opened, allowing the cosmetic article to be inserted into or removed from the upper portion of the cavity, and, when closed, preventing the cosmetic article from exiting the upper portion of the cavity;

wherein the housing is of a size and shape suitable for use as a handle such that it may be gripped by a user to apply the cosmetic.

2. The applicator device of claim 1, wherein the second cosmetic article is a disposable wipe.

3. The applicator device of claim 2 further comprising a sleeve having an sleeve opening disposed over the housing, wherein the housing comprises a housing opening through the outer body portion thereof, the housing opening for passing the second cosmetic article from the cavity to the user when the housing opening is aligned with the sleeve opening.

4. The applicator device of claim 1, wherein the housing comprises an activator unit that, when activated by a user, moves the second cosmetic article in reach of the user.

5. The applicator device of claim 4, wherein the second cosmetic article is a cotton swab and the activator comprises a grasp for holding a shaft of the cotton swab.

6. The applicator device of claim 4, wherein the second cosmetic article is a pad and the activator comprises a lift for moving the pad.

7. An applicator device comprising:

a wand having an applicator unit for applying a cosmetic to a user connected to one end thereof; and a housing adapted to fit over the applicator unit, the housing comprising an outer body portion defining an interior cavity having a lower portion and an open upper portion separated by a partition, the lower portion adapted to secure the applicator unit therein, and the upper portion having a plurality of single-use cosmetic articles for use by the user disposed therein selected from the group consisting of swabs, cotton swabs, cotton buds, wet wipes, dry wipes, cotton balls, tissues, coated swabs, impregnated wipes, compressed cotton swabs, woven pads, non-woven pads, and coated pads.

8. The applicator device of claim 7, wherein the housing comprises an activator unit that, when activated by a user, moves the second cosmetic article in reach of the user.

9. The applicator device according to claim 7 further comprising a lid attached to the outer body portion of the housing, the lid, when opened, allowing the cosmetic article to be inserted into the upper portion of the cavity, and, when closed, preventing the cosmetic article from exiting the upper portion of the cavity.

10. An applicator device according to claim 8, wherein the second cosmetic article is a disposable wipe.

11. An applicator device according to claim 10 further comprising a sleeve having an sleeve opening disposed over the housing, wherein the housing comprises a housing opening through the outer body portion thereof, the housing opening for passing the second cosmetic article from the cavity to the user when the housing opening is aligned with the sleeve opening.

12. An applicator device according to claim 7, wherein the housing comprises an activator unit that, when activated by a user, moves the second cosmetic article in reach of the user.

13. An applicator device according to claim 12, wherein the second cosmetic article is a cotton swab and the activator comprises a grasp for holding a shaft of the cotton swab.

14. An applicator device according to claim 12, wherein the second cosmetic article is a pad and the activator comprises a lift for moving the pad.

* * * * *